US006192906B1

(12) United States Patent
Kuo

(10) Patent No.: US 6,192,906 B1
(45) Date of Patent: Feb. 27, 2001

(54) AUTOMATIC OPENING UMBRELLA MECHANISMS

(76) Inventor: Cheng Miao Ling Kuo, 8F, No. 39, Sau nen Street, Hsinchu (TW)

( * ) Notice: Subject to any disclaimer, the term of this patent is extended or adjusted under 35 U.S.C. 154(b) by 0 days.

(21) Appl. No.: 09/379,737

(22) Filed: Aug. 24, 1999

(51) Int. Cl.[7] ..... A45B 25/16

(52) U.S. Cl. ..... 135/25.1; 135/20.3; 135/28; 135/37

(58) Field of Search ..... 135/19.5, 20.3, 135/40, 38, 39, 37, 23, 26, 28, 29, 31, 25.1

(56) References Cited

U.S. PATENT DOCUMENTS 3,508,560 * 4/1970 Kitani ..... 135/20.3
6,006,770 * 12/1999 Lin et al. ..... 135/31 X

* cited by examiner

*Primary Examiner*—Daniel P. Stodola
*Assistant Examiner*—Erica B. Harris
(74) *Attorney, Agent, or Firm*—Rosenberg, Klein & Lee

(57) ABSTRACT

An automatic opening umbrella mechanism which provides a new design, by which users can open an umbrella in a quick and accurate manner with enhanced efficiency. The structure primarily contains a spring disposed between the midpoint of a first main umbrella stretcher and the upper end of the umbrella runner. The resilient restoring force of the spring helps opening an umbrella.

4 Claims, 4 Drawing Sheets

AUTOMATIC OPENING UMBRELLA MECHANISMS

BACKGROUND OF THE INVENTION

Conventional automatic umbrellas use springs seated in the umbrella stick to open an umbrella canopy. When the runner escapes from the retention and the stick extends, the runner moves upwards and the umbrella stretcher system spreads out to complete the opening operation of an umbrella. However, these known umbrella structures often malfunction due to the limitation of a single spring's insufficient resilient forces and the umbrella stretchers' fundamental structure. Users can not open the umbrella completely and smoothly. Thus it is desirable to have improvements made on conventional opening umbrella mechanisms to eliminate these deficiencies.

In view of the above problems, the present invention is to provide an improved opening umbrella mechanism in which a spring is disposed between the runner and the first main umbrella stretcher to provide an auxiliary pulling force in the opening operation of the umbrella to achieve a smooth opening effect. Now the structural features and advantages of the invention will be described in detail with reference to the accompanying drawings.

BRIEF DESCRIPTION OF THE ACCOMPANYING DRAWINGS

DETAILED DESCRIPTION OF PREFERRED EMBODIMENTS

Figure 1:
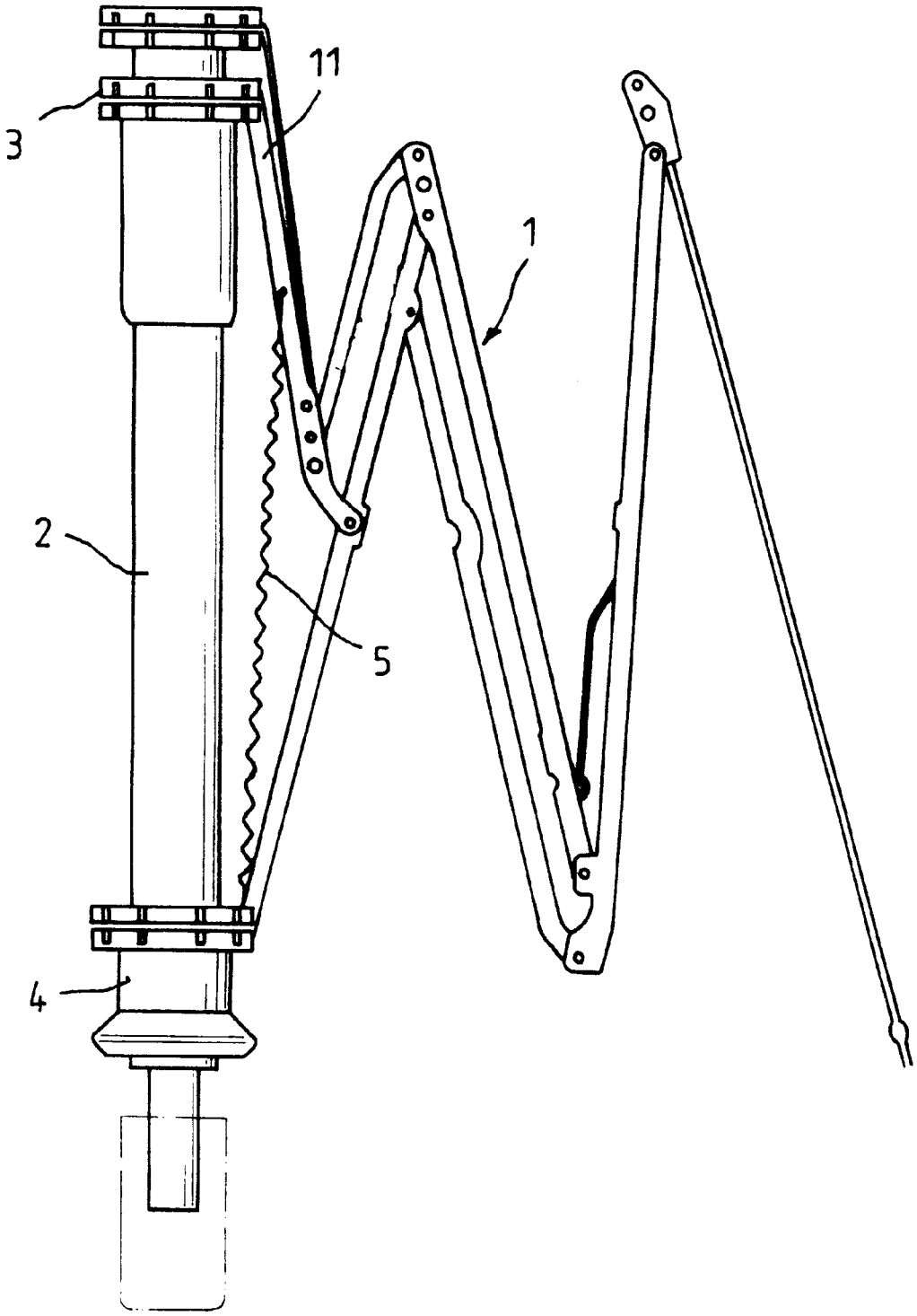
FIG. 1 is a plan view showing the opening mechanism of a quadruple foldable umbrella according to the invention in a state in which the umbrella is closed.
Figure 2:
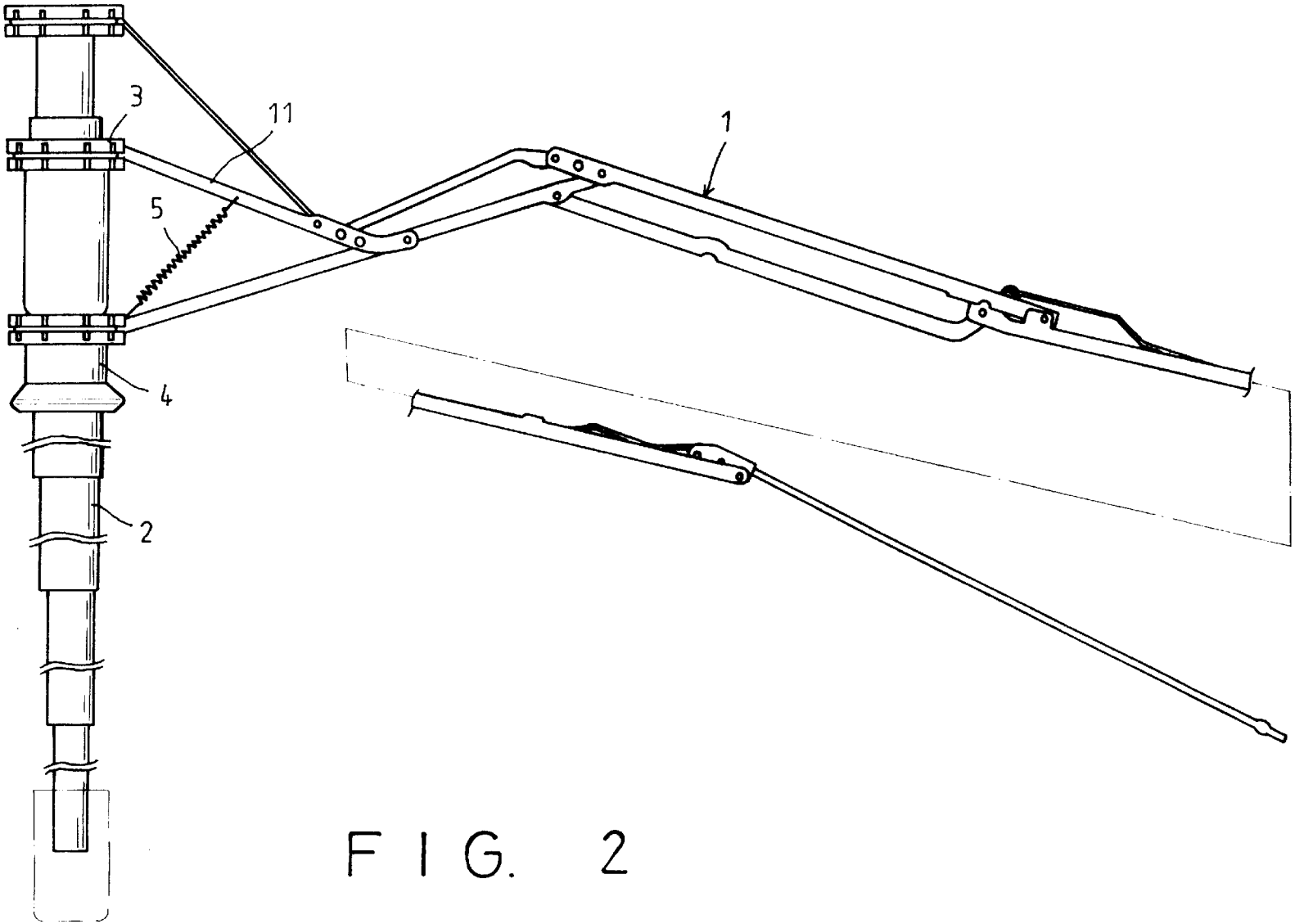
FIG. 2 shows the opening mechanism of FIG. 1 in an open state.

FIGS. 1 and 2 show an exemplary application of the opening mechanism according to the invention used in a quadruple foldable umbrella. The opening mechanism comprises an umbrella stretcher system (1), an umbrella stick (2), an upper grooved element (3) and a runner (4). These components are the same as those of a prior art umbrella and are well known to the public. Thus they will not be described in detail here. The invention is featured by a spring (5) disposed between the midpoint of a first umbrella stretcher (11) and the upper end of the runner (4). When closing the umbrella as shown in FIG. 1, the spring (5) is stretched. In an operation of opening the umbrella, the runner (4) will escape from the retention and move up. Under the resultant resilient forces of the spring in the umbrella stick in conjunction with the auxiliary spring (5), the umbrella canopy can smoothly stretch out. Thus the opening operation can be more quick and accurate.

Figure 3:
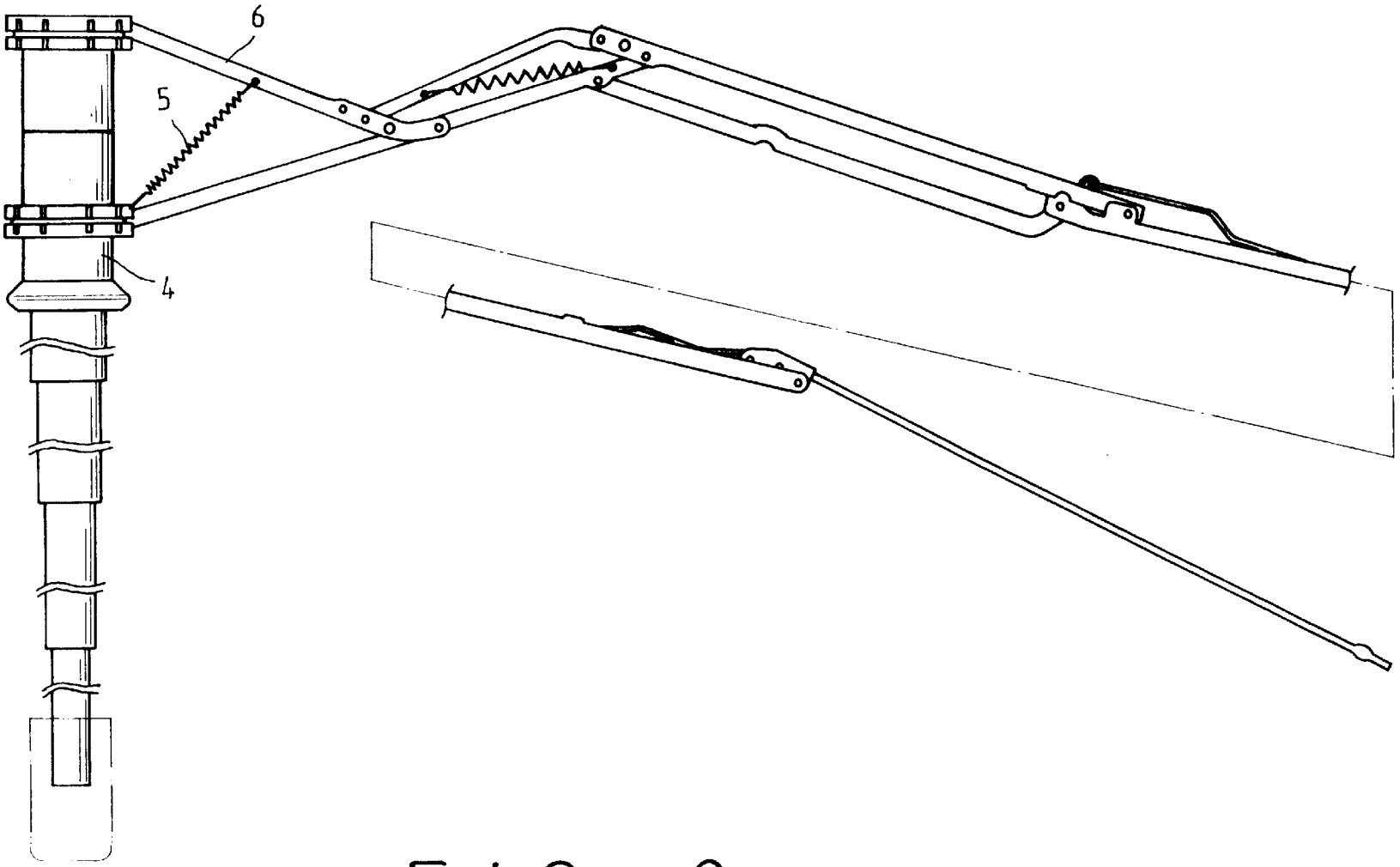
FIG. 3 shows the opening mechanism of a quadruple foldable umbrella according to the invention in a state in which the umbrella is open.

FIG. 3 shows an application of the embodiment of an opening mechanism according to the invention used in an automatic quadruple foldable umbrella. The spring (5) is connected at one end to the upper end of the runner (4) and at the other end to the midpoint of a first main umbrella stretcher (11). The spring provides an auxiliary force to pull the runner (4) to the upper end of the umbrella stick during an opening operation.

Figure 4:
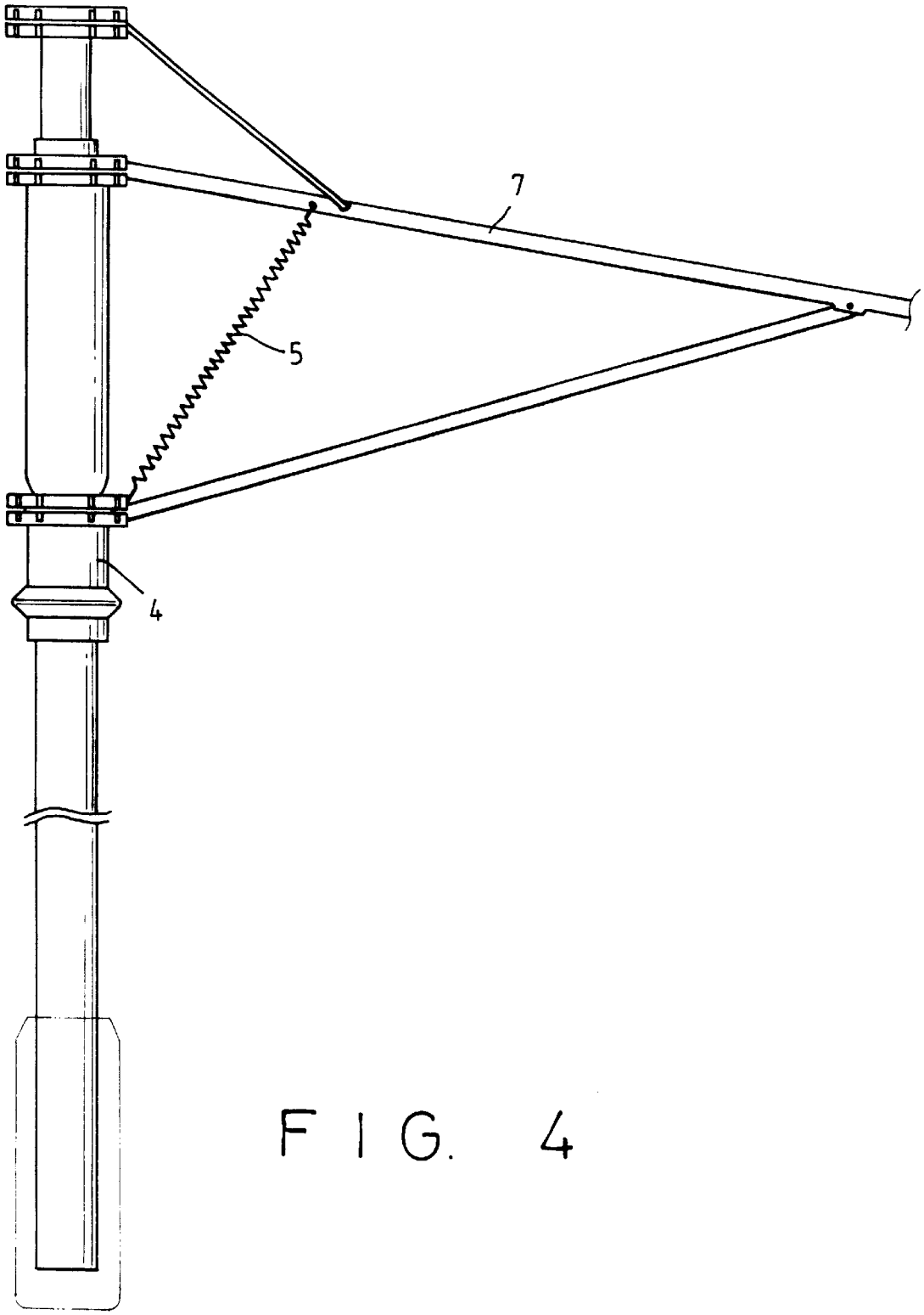
FIG. 4 shows an exemplary application of the opening mechanism according to the invention used in an umbrella with a straight stick.

FIG. 4 shown another exemplary application of the opening mechanism according to the invention used in an automatic straight umbrella. The spring (5) is also disposed between an umbrella stretcher (7) and the runner (4) to achieve the same auxiliary effect as the one described above.

From the described above, the invention uses an additional spring to serve as an aid to the opening operation of an umbrella. Evidently it can achieve the effect set forth at the beginning of the text. Besides it also has originality in structure. Thus the invention has the essence of a patent. We hereby file an application of granting a patent.

What is claimed is:

1. An opening mechanism for an automatically extendable umbrella comprising:

(a) an elongate umbrella stick;

(b) a runner displaceably coupled to said umbrella; and, (c) a collapsible umbrella stretcher system coupled to said runner for reversible extension responsive to said displacement thereof, said umbrella stretcher system including:

(1) at least one elongate main stretcher member having distal end portions and an intermediate portion extending therebetween, said main stretcher member being pivotally coupled at one end portion thereof to an upper portion of said umbrella stick for pivotal displacement between umbrella opening and closing positions; and, (2) at least one spring member extending between said runner and said main stretcher member intermediate portion, said spring member being expanded to resiliently bias said runner responsive to said main stretcher member being in said umbrella closing position thereof, said spring member being substantially relaxed responsive to said main stretcher member being in said umbrella opening position thereof.

2. The opening mechanism as recited in claim 1 wherein said spring member is a coiled tension spring adapted to resiliently bias said runner upward on said stick responsive to said main stretcher member being in said umbrella closing position thereof.

3. The opening mechanism as recited in claim 1 wherein said umbrella stretcher system is of a multiple foldable automatic type.

4. The opening mechanism as recited in claim 1 wherein said umbrella stretcher system is of a straight automatic type.

* * * * *